United States Patent [19]

Firth

[11] Patent Number: 4,564,297

[45] Date of Patent: Jan. 14, 1986

[54] VIBRATORY TREATMENT OF MOVING SURFACES

[76] Inventor: Francis G. Firth, 96 Blue Lagoon, 30781 S. Coast Hwy., Laguna Beach, Calif. 92651

[21] Appl. No.: 524,653

[22] Filed: Aug. 19, 1983

[51] Int. Cl.[4] ..... B01F 11/00

[52] U.S. Cl. ..... 366/108; 68/3 SS; 366/116; 366/127; 366/600

[58] Field of Search ..... 68/3 SS; 74/1 SS, 87; 118/419, 428, 429; 134/1, 122 R, 184; 198/631; 226/191, 193; 242/76; 310/321, 322, 325; 366/108, 114, 116, 117, 118, 126, 127, 128, 600; 427/434.4

[56] References Cited

U.S. PATENT DOCUMENTS

| | | | |
|---|---|---|---|
| 2,800,682 | 7/1957 | Dooley | 68/3 SS |
| 3,370,758 | 2/1968 | Bodine | 74/87 |
| 3,405,855 | 10/1968 | Daly | 226/193 |
| 3,813,950 | 6/1974 | Ebersole | 74/87 |
| 4,184,787 | 1/1980 | Uebel | 74/87 |
| 4,352,570 | 10/1982 | Firth | 366/127 |

*Primary Examiner*—Robert W. Jenkins

*Attorney, Agent, or Firm*—William W. Haefliger

[57] ABSTRACT

Process and means to enhance fluid coverage of surfaces in industrial applications. Generation of a directed force field is employed to provide removal of surface air, improve surface wetting of a fluid, and consolidation and densification of fibrous structures.

Apparatus of the invention is described which provides vibratory forces of appreciable magnitude and super-audio frequency and applied to solid, fluid and gaseous combinations, to displace surface gas and promote fluid contact with the solid surface. Apparatus of the invention facilitates the generation and application of the vibratory energy to composite structures of synthetic or natural fibers with a fluid resinous material.

34 Claims, 8 Drawing Figures

VIBRATORY TREATMENT OF MOVING SURFACES

BACKGROUND OF THE INVENTION

Numerous industrial processes are characterized by problems (to a greater or less degree) with the development of a positive fluid-solid interface, where the fluid is required to completely wet the solid surface. Printing inks on glossy surfaces, tin solders on printed circuit boards, dye solutions on fabrics, and resinous impregnation of fibrous materials, such as glass fiber, graphite, and aramid, are examples where efficient wetting has importance.

Part of the problem is caused by difficulties associated with an economically viable speed of the work through a coating or impregnation tank, air that will not readily become displaced from the work surface, and the lack of pressurizing means to force the fluid against the solid surface.

The patent literature and commercial applications recognize the problem and address it in various ways. Ultrasonic means for tinning wire in U.S. Pat. No. 3,685,487 employs magnetostrictive transducers to agitate a bath of tin alloy by vibration of the bottom of the tank. The fluid is put into motion which improves contact with the moving wire. U.S. Pat. No. 3,330,680 to Knapp also involves the coating of wire in a tank agitated by ultrasound.

U.S. Pat. Nos. 3,393,661; 3,401,542; 3,422,796; 3,511,730; 3,827,397; 4,020,196; 4,025,671; 4,059,068; all teach improved impregnation means by the use of grooves of different shapes in surfaces over which the impregnant passes. Impregnation fluid is forced through the grooves to contact the underside of the passing material.

Certain restrictions exist in such application methods, due to limited practical flow pressure through orifices. In the case of small diameter fibers such as 0.0005" graphite or glass fiber, the danger of breaking strands, and causing expansion of the bundle of fibers due to pressure, is ever present and highly undesirable, particularly in filament winding applications. Resinous materials used for reinforcing composite fibers are also high in viscosity and do not pass through a fiber bundle readily, as is necessary to displace air entrapped in the center. To increase the penetration difficulty, most fibers used for weaving and filament winding are twisted and sized to prevent fuzzing during the mechanical manipulations.

Existing process means for resinous impregnation of fibrous materials typically require a series of freely rotating rollers immersed in a tank of impregnating resin, over which the fiber passes, so that bending and squeezing forces tend to void the entrapped air, and to develop contact of the resin with the fibre. Speed through the bath is an economic consideration but is limited by the resin viscosity and drag on the fiber due to adhesion of the resin on the rollers.

SUMMARY OF THE INVENTION

It is a major object of the invention to provide method and means to overcome the above described problems and difficulties. As will be seen, the method of the invention involves employment of a body, such as a roller for example, which has a generally cylindrical outer wall to treat a work surface moving relative to the body, the steps of the method including:

(a) effecting vibration of the wall, to produce radial oscillation thereof, (b) causing the wall to contact the relatively moving work surface while the wall rotates thereby to transmit said radial oscillation to said work surface.

As will be seen, application of the invention to treatment of work fiber enable higher speed of fiber travel through a viscous medium by reducing static cohesive forces at the interface of the roller means and the passing fiber by the efficient application of vibratory force fields, which also have sufficient energy to displace air from a tightly twisted fiber bundle, and force the fluid against the fiber. The surface area of a typical roving bundle can be of the order of 37 square inches per foot, and might consist of 1000 or so strands in a nominal 0.090 inch yarn, which might illustrate the nature of the difficulty. Other factors such as surface chemistry and compatibility with the higher molecular weight resinous compounds, are further impediments to an efficient process.

The invention also relates to means for applying ultrasonic energy to a rapidly moving surface contacted by a viscous fluid, and to provide forces suitable to displace entrapped air. The selective action is one of fast fluid displacement off a rapidly vibrating surface, which alternately expands and compresses any gas which coalesces to larger bubbles, which are easily removed by mechanical movement. The basic combination provides by the invention includes:

(a) a body having a generally cylindrical wall relative to which the work is movable, (b) means for causing said wall to contact the relatively moving work surface while the body wall rotates, and (c) means associated with the body for effecting vibration of said wall to produce radial oscillation thereof thereby to transmit said oscillation to said work surface.

As will be seen, the (c) means is typically oriented to also produce wall oscillation along its length in contact with the work surface.

As further background, the velocity of sound through any medium is proportional to the square root of the ratio of the coefficient of elasticity, and the density of the medium. The velocity of sound for air = 1088 ft/sec., Water = 4700 ft/sec., glass = 20,000 ft/sec., and typical resinous materials about 3700 ft/sec. Fiber density of "E" glass is 2.60, and graphite fiber is 1.74. Resinous impregnation materials normally have densities around 1.2 to 1.3. This differential range of fibers and resins, and compared to air, is adequate to produce high pressure gradients in the different media from suitable ultrasound energy sources.

A desirable (but not essential) configuration for energy field generation useful under the aforementioned process applications, consists of a right cylinder with coaxial bearing hubs, enabling rotation about the central axis. The surface of the drum acts as the vibrating surface, and can be internally activated at appropriate frequencies and energy levels. Vibratory energy is supplied by efficient means employing the conversion of electrical to mechanical energy, which is directed to substantial vibratory movement of the cylindrical diaphragm or wall. The applied electrical power and subsequent mechanical response is only limited by the partial conversion to heat, and by the physical strength and fatigue limits of the materials of construction.

Various mechanical methods can be employed to cause vibratory energy to be radiated from the roller surface, including alternating pressure internally by periodic interruptions of fluid or gaseous streams. Mechanical compression and pressure release against the end closures of the cylinder, by rotating cams or electromagnetic means, and similar devices and techniques will provide some movement of a flexible drum; however, the frequency available by these means is strictly limited, and the amount of energy totally inadequate for the intended tasks. Ultrasonic energy on the other hand can be efficiently generated by conversion of pulsating or alternating current to mechanical energy by use of piezoelectrical elements, ferromagnetic elements such as ferrites, or nickel stack with external magnet windings to supply an alternating magnetic field. By preference, the use of piezoelectric ceramics which are more efficient, and generate far less heat for comparable levels of mechanical energy conversion, is preferred.

These and other objects and advantages of the invention, as well as the details of an illustrative embodiment, will be more fully understood from the following specification and drawings, in which:

DRAWING DESCRIPTION

FIGS. 1–4 are side elevations, in section, showing apparatus employing the invention;

FIG. 1*a* is a fragmentary view of a cylinder wall;

DETAILED DESCRIPTION

Figure 1:
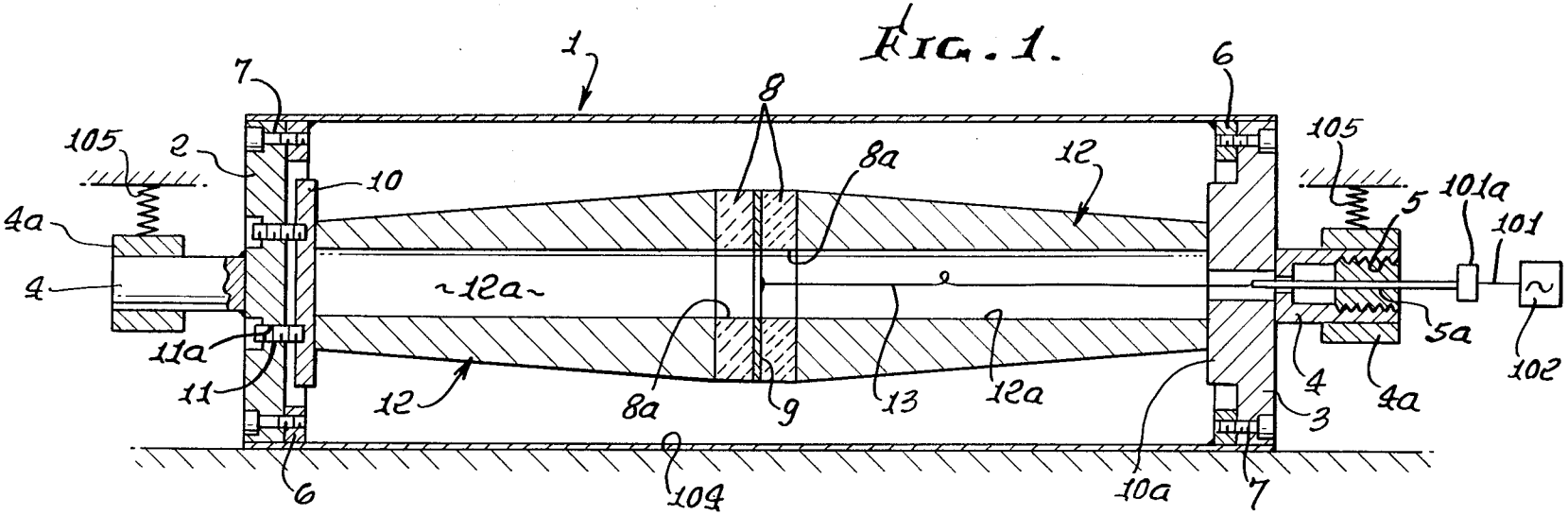

Fundamentally the initial problem to be solved is how to produce high energy content vibrations at the surface of a rotatable drum in a practical manner. A useful and efficient converter of electrical to mechanical energy is the piezoelectric transducer. At a practical and commercial level where considerable power conversion is required, fired ceramic compositions are commonly employed to power apparatus such as cleaning baths, dental tools, soldering irons, inking devices for printing, to name a few. U.S. Pat. Nos. 2,725,219, 2,566,984, 2,624,709, 2,530,224, and 4,305,275 disclose examples.

Modern piezoelectric ceramics are composed of various combinations of divalent metals such as lead, barium, or strontium, and tetravalent elements such as titanium and zirconium which are processed by methods common to the ceramic industry, pressed to a desired shape, and fired under controlled atmospheric conditions, to form a pseudoisometric or monoclinic structure.

Selected parallel sides are placed between electrodes in a hot insulating fluid bath held at temperature above the known Curie Point for the particular composition. A high voltage direct current is applied across the electrodes and maintained while the bath temperature is reduced to lower levels. This produces an activation of the ceramic called poleing which is essentially permanent, unless the Curie Point is exceeded. A permanent decrease in dimension parallel to the electrodes, and an increase in the direction of the electrical axis is a result of poleing. The surfaces to which the electrodes were applied are then coated with a conducive metal, and if a direct current voltage of the same polarity as the poleing voltage is applied there is a proportionate but temporary expansion in the poleing direction, and contraction parallel to the electrodes, since the net volume is unchanged. Removal of the applied voltage permits the ceramic to return to the original shape. Thus, a pulsating or alternating current applied in a similar manner will cause the ceramic to vibrate as a mechanical oscillator. The limitations to the amount of power that can be obtained from a given configuration is established by the heat generated from electrical and mechanical losses, and fracture of the ceramic due to tensile stress.

Ceramics are poor in tensile, but very strong in compressive strength. For this reason ceramic transducers for power generation are usually kept in compression by suitable mechanical means. Heat can be removed by coolant application or by radiating expanded surfaces attached to the ceramic.

The mechanical displacement of an excited ceramic transducer is small, and enhancement of the amplitude of the movement is desirable, especially for supersonic frequency in a preferred mode between 20 and 50 K.Hz. Various techniques are available to increase mechanical amplitude of oscillatory movement, such as the use of acoustic transformers normally called horns, which consist of specific metal shapes attached to the vibrating surface. The horns are usually of a conical shape and some specified length. The most efficient shape of the cone is exponential, which permits a conversion ratio equivalent to the area of the large end in contact with the oscillating surface, divided by the smaller end area in a linear relationship. In other words if the ratio is 10 the mechanical amplitude is multiplied 10 times. The horn length is selected to avoid interferance from load impedance mismatch at the work end. For good energy transfer the horn composition should be selected from a low density, high modulus, high elongation metal such as a suitable titanium alloy known to be fatigue resistant. Some aluminum hard alloys have also demonstrated useful properties.

Ceramic transducers can be stacked in series to improve amplitude displacement at lower driving voltages, provided attention is paid to polarity of the ceramic. Transducers may be of any symmetrical shape and of a size governed by the constraints of ceramic technology, such as bars, cylinders, flat disks, or other. U.S. Pat. No. 2,725,219 to Firth illustrates the use of shaped horns to enhance transducer amplitude. Mechanical pressing or extrusion requirements, and firing shrinkages, must be considered in the selection of finished shapes that will be highly stressed during use. The most economical applicable shapes judged suitable for power conversion are flat discs with center holes, and small wall thickness. Right cylinders poled across the wall are especially useful in the endwise vibratory mode.

The cylindrical diaphragm may be attached rigidly to, and supported by, rigid end plates or caps so that relative movement of one to the other outwardly will tend to stretch the diaphragm endwise. If the cylindrical diaphragm is stretched by end cap location and movement, a reliable surface vibrational mode is difficult to establish in a straight surface; if however the cylindrical surface has enhanced compliance due to inclusion of circumferential deformities or ridges in a thin wall configuration, vibrational modes are permissable. The cylinder thusly preferably comprises a thin wall tube that has been deformed along its length into a corrugated or pebbled surface after annealing and attached to the end caps either mechanically or by welding means and subsequently heat treated to develop good hysteresis and fatigue properties. A typical suitable material, for instance, is a beryllium copper alloy. Thus if the end caps of such a device be moved outwardly relative to each other, the surface of the diaphragm will be displaced radially. Therefore, if the mechanical movement of an oscillatory transducer can be coupled to the end plates of the aforementioned device efficiently, the diaphragm will also vibrate at that frequency or some harmonic thereof. Some typical applications follow:

Hollow structures such as cylinders, spheres, aerospace structures, and similar lightweight bodies, are often wound with woven, unwoven, or rovings of graphite, aramid, or glass fiber, after impregnation of the dry fiber with a fluid resinous material. The densification of the wound impregnated fiber on the winding mandrel has previously been obtained by the tensile forces required to unwind the fiber from the spool, friction and drag in the resin bath, and friction of the fiber running against the guidance posts of the traverse carriage. Strong fiber bundles such as glass fiber and aramid can be controlled to a desired tension; however, graphite fiber in the unimpregnated, uncured state is relatively weak in tension and will break if too much force be applied. The resin content of any composite is a critical parameter in physical properites determination, and densification during winding will tend to remove excess resin from the somewhat random spaces left due to the winding pattern and adjacent turns.

The use of the aforementioned ultrasonic impregnator means, when used as a roller follower, can be effectively carried out by locating it in contact with the winding surface at a point just after the fiber has contacted the rotating mandrel. This will enhance the layering of the fibers, producing a higher degree of uniformity, and by densification will tend to improve the interlaminar shear strength of the structure due to better load transfer from adjacent fibers. In particular in such filament wound configurations employed as highly stressed pressure vessels (such as missile motor bodies, pressure pipe, spars, helicopter blades, and the like) high interlaminar shear values are of critical importance in establishing a safe and useful service life.

A major problem in the use of high temperature, high performance composites as applied to highly stressed components used in aerospace work, and which are subjected to elevated temperatures estimated in terms of an expected service life of 50000 hours, is a gradual degradation of physical properties. The present state of the art indicates a safe operating maximum temperature somewhat above 400 degrees for epoxy resins, and some polyamids at about 600 degrees F.

Ultrasonic "C" scan of test laminates taken after careful preparation and cure, and of the same sample set after a few thousand hours of exposure to an anticipated operational temperature, will generally show a propagation of the magnitude of voids, from the initial ones detected as minor defects. Physical testing will show that there is some correlation between the void propagation and drop off in physical properties. Loss of tensile and flexural strength of 50% or more are not uncommon when testing is done at the service temperature.

Thermal aging in polymeric stressed systems has been attributed to a number of mechanical and chemical factors, and with varying degrees of sophistication, i.e. surface chemistry of the fiber/resin interface, air and water on the fiber causing channeling, differential coefficients of expansion between the matrix and reinforcing fiber. Of these few mentioned sources of inconsistancy in a repeatable useful structure, there is no doubt that surface and entrapped air in the cured composite is a potent factor in determination of service life.

The mechanical problem has to do with the fact that when the cure cycle at elevated temperature is in progress, the air bubbles expand in the soft resin and create permanent voids to a greater or less degree. At operational temperatures and under stress the voids act as stress raisers and can initiate vitreous fractures. A further phenomena is caused by the presence of air which supplies oxygen internally, and at elevated temperatures creates local depolymerization, and can unload stressed adjacent fibers. This localized softening can be progressive as visualized by the "C" scan as due to the unloading of the winding stresses.

In typical winding practice, attempts to minimize this ever present potential problem involve the application to the part of a vacuum bag, or autoclaving of the part, if practical. These techniques do not eliminate the entrapped air but compress same to smaller volume and build up higher internal stress levels in the matrix due to the higher initial pressure in the bubble. A reasonable conclusion to this somewhat simplified rationale is that air is not a useful component of high temperature stressed composites, and that any degree of relief should enable parts to be made with improved heat aging properties.

A problem exists in composite technology during a procedure called hand lay up, wherein a woven or nonwoven fabric is impregnated with a polymerizable resin, and laminated one layer on another to form a desired shape, and thickened section. It is highly desirable that the layers develop a monolithic structure, without interlaminar voids, or poor resin distribution. The process of achieving a desirable fiber to resin ratio is called densification, and a uniform fiber volume is essential to repeatable physical properties. Rub out with squeeges, and application of an impervious flexible bag over the laminate, and drawing a vacuum on the bag are commonly employed to reduce entrapped air and to apply a moderate pressure on the laminate. Excess resin is also reduced by use of bleeder dry fabrics inside the bag and in contact with the laminate through a porous separator membrance, all of which are later discarded.

In accordance with the present invention, the application of directed ultrasonic energy to the layered wet fabric during layup can develop dynamic compression forces greatly exceeding those made possible by vacuum bag or autoclave means, and provide an excellent method of rolling out air, and achieving densification. The described ultrasonically activated cylindrical drum, can be employed as will appear as a squeegee by rolling over the laminate directly, or over a vacuum bag to produce localized energy fields, which will facilitate air removal, and consolidation.

Further advantages to be gained by suitable application of ultrasonic energy forces to high performance laminated structures, include improvement in fatigue strength especially in highly flexed composites as in helicopter and turbine blade construction. When a laminate is rapidly and repeatedly flexed at high stress levels, the entrapped air bubbles are heated due to adiabatic compression, and the local temperature can easily exceed the thermal glass point of the matrix in particular if relatively large voids are present, which tends to reduce the practical service life.

Resinous matrices commonly employed for composite impregnation are found to contain substantial amounts of gel particles which are invisable by observation, but upon filtration through a pressure filter with a 10 micron element, will show a surprising quantity. Commercial resins are not usually so filtered, and the presence of such insoluble soft particles in a laminate can result in local soft spots and mechanical discontinuities, with a resultant lowering of desirable physical properties. Application of the ultrasound energy during lamination tends to break the gel particles into smaller fractions and reduce this deleterious effect.

Having described the general configuration of the apparatus and its operation, as well as the unique benefits derived from the use thereof, a detailed description of preferred embodiments follow.

Figure 1A:
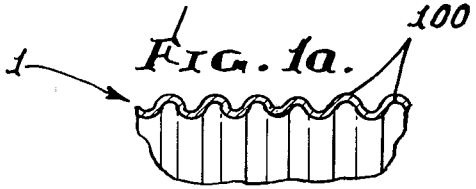

In FIG. 1 a thin wall tubular cylinder 1 is provided with concentric convolutions 100 (see concentric rings 100 in FIG. 1*a* for example). The cylinder wall acts as the energy radiating surface, and is welded, mechanically or otherwise fastened, to ring attachment means 6 at each end. Rigid end plates 2 and 3 are attached to rings 6 as via a circular series of machine screws 7 or alternate securing means. Integral with the outer ends of the rigid end plates are hub projections 4, capable of acting as supports or bearings for rotation of the cylinder. Bearing supports appear at 4*a*.

Two piezoelectric, ceramic, polarized transducer discs 8 with central holes 8*a* are centrally and axially located within the cylinder, and have an electrically conducting washer 9 located between them. On the axially outer surfaces of the discs are located rigid, uniform, conical cylinders 12 with through holes 12*a* to match the transducer holes 8*a*. The smaller ends of the cones are each mechanically and severally attached to thrust plates 10 and 10*a*, to be held concentric with the long axis of the cylinder. Plate 10*a* is integral with end plate 3. Cones 12 may be metallic.

Circularly spaced screws 11 are situated in end cap 2 and fit in threaded holes 11*a*. The screws can be tightened to press against plate 10, and to tension the tubular diaphragm 1 by transmitting forcd through the two cones, the ceramic transducers 8 and to the end cap 3. The hub 4 on cap 3 is provided with a coaxial electrical receptacle 5 with an internal insulating bushing 5*a* through which passes an electrical conductor 101 attached to a wire 13 connected to washer 9 between the electrically conducting surfaces of the discs 8. Conductor 101 may press against a contact 101*a* to which AC is applied from source 102. Means are thus provided to electrically connect the transducers through a swiveled coaxial connector to a suitable insulated wire connected to the power source. The transducers are held in compression by the cones, which can in turn be held in compression by adjustment of the screws 11. This in turn applies tensile forces to the cylindrical diaphragm and holds it taut. When the transducers are electrically excited by an applied voltage of suitable frequency and energy content through connector 5*a*, they will vibrate and tend to alternately relax and increase the diaphragm tension, and the diaphragm in turn will oscillate radially at the applied frequency or some harmonic thereof. Note that the transducers rotate with the cylinder; and that the cylinder convoluted surface is vibrated axially and radially to vibrate the work surface 104 in two directions. A spring or springs 105 may urge the cylinder against the work.

Figure 2:
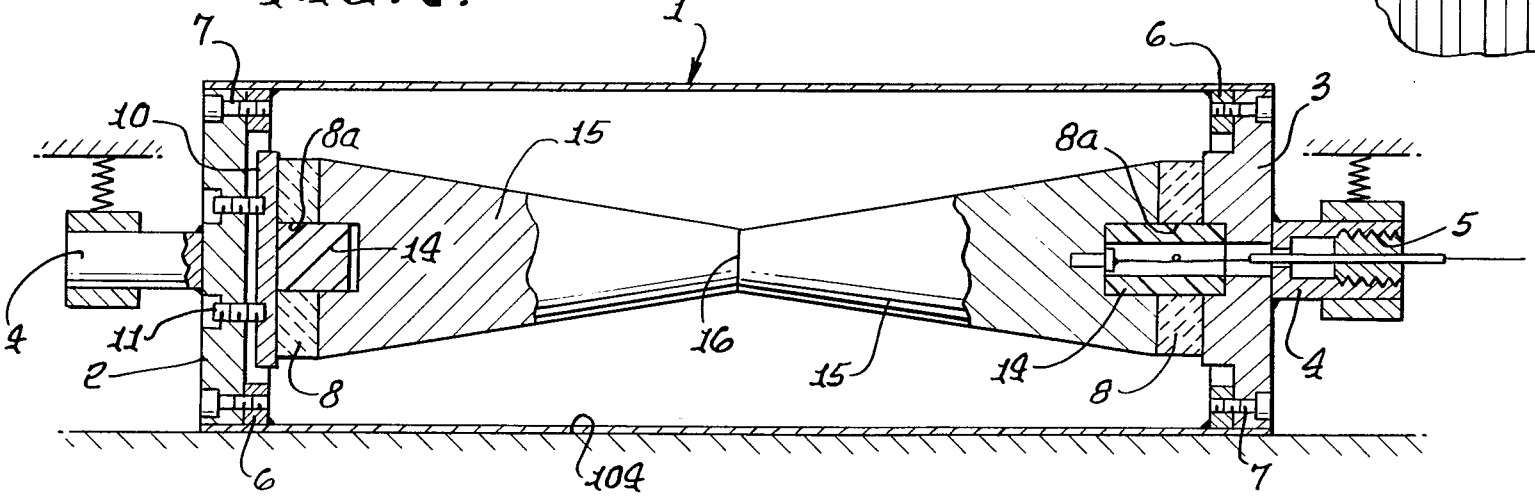

The transducer elements may be placed one at each end with a compression element in between. FIG. 2 shows the transducer 8 mounted by locating central holes 8*a* on insulating plugs 14, for example of a fluorocarbon composition. Shaped metal symmetrical dual cones 15 are also positioned to have their large ends on the transducers, and their smaller ends in engagement at the center 16. Pressure can be applied uniformly to the pressure plate 8 by the screws 11 as in FIG. 1.

Figure 3:
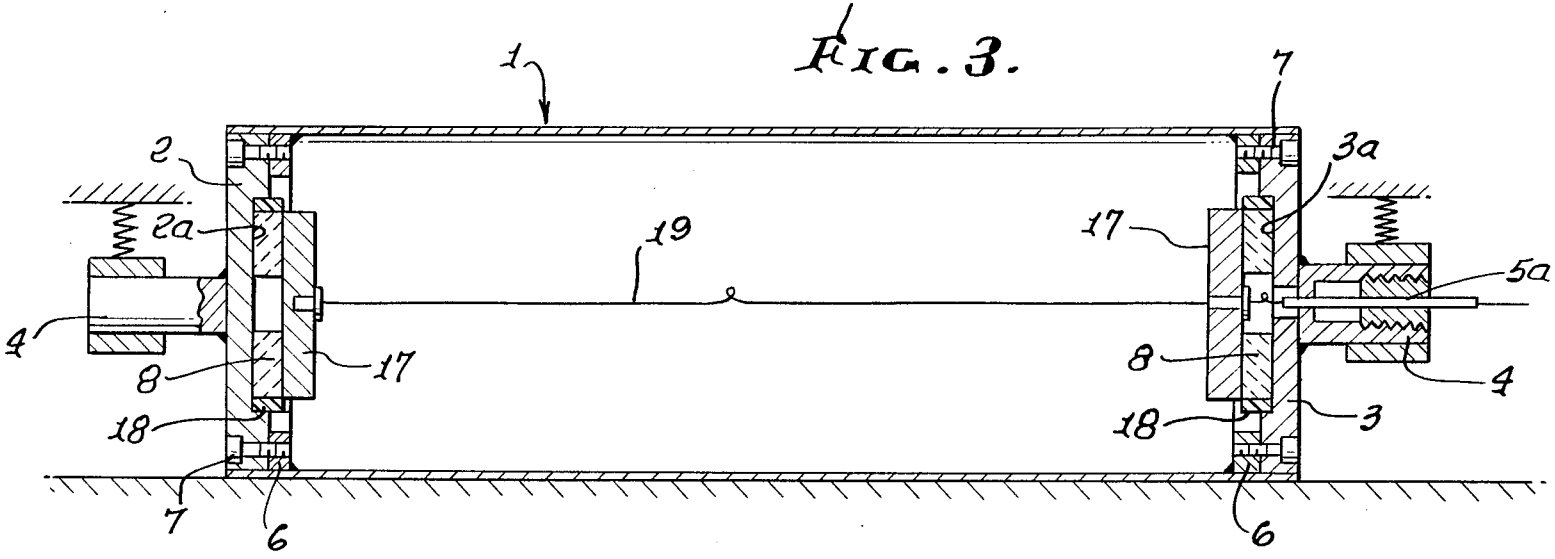

FIG. 3 is a design for applications where a lower inertia in the drive system might be desirable, such as higher frequency requirements. It is possible to mount the transducers 8 directly on the end plates 2 and 3, as in recesses 2*a* and 3*a*, and to attach masses 17 on the inwardly facing surfaces of the transducers to provide a reaction force against the free oscillating frequency of the transducers and to provide a measure of frequency control. An insulating sleeve 18 about each transducer prevents arcing during use. A wire 19 is used to connect the two transducers to the power inlet connector 5*a* the transducer ceramic, reaction mass, and end plate can be secured to each other by soldering, adhesive bonding, or other means. If the requirements for attachment means exceeds the Curie Point of the ceramic, the assembly can subsequently be repolarized in a normal fashion.

Figure 4:
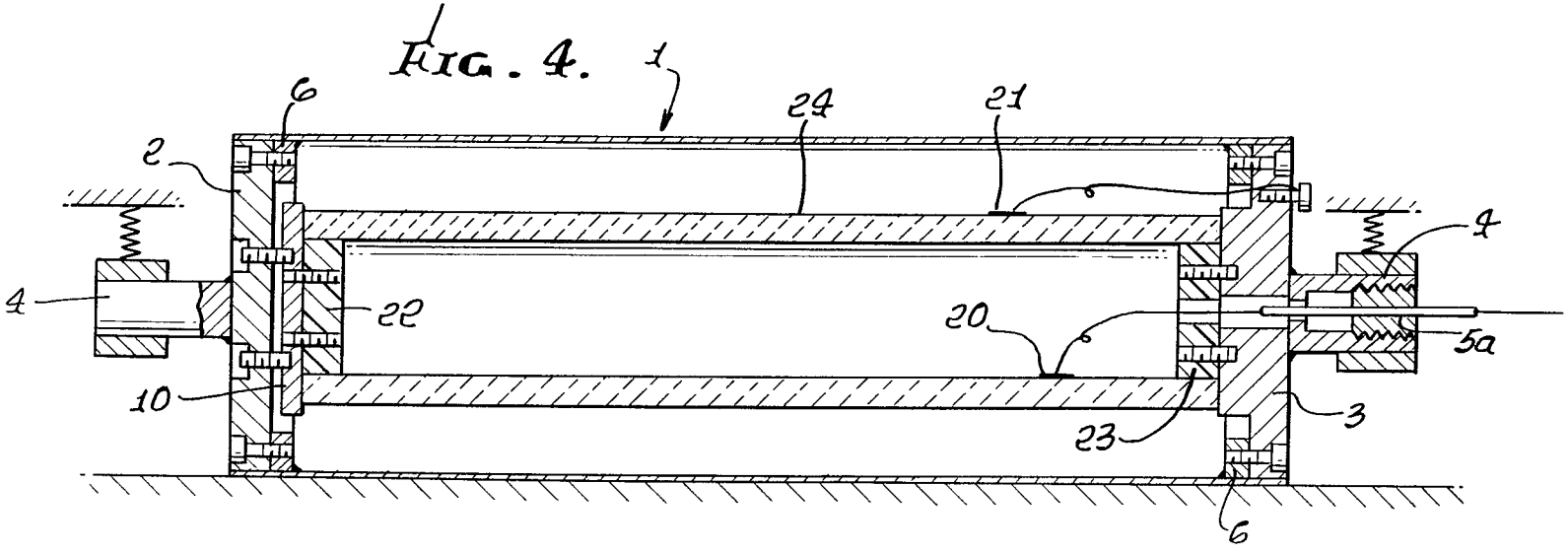

FIG. 4 shows a cylindrical transducer 24 which is utilized to deliver ultrasonic energy along the length dimension. The inner and outer surfaces 20 and 21 are made conductive, and polarization is effected through the wall thickness. In this case, due to Poissons ratio, the cylinder expands along its length when excited across the wall thickness. Items 22 and 23 are insulating plugs respectively attached to the end cap 3 and the compression plate 10 for holding the cylinder in place. Compression is applied to the cylinder ends as before to provide tension in the diaphragm, i.e. cylinder wall 1.

Figure 5:
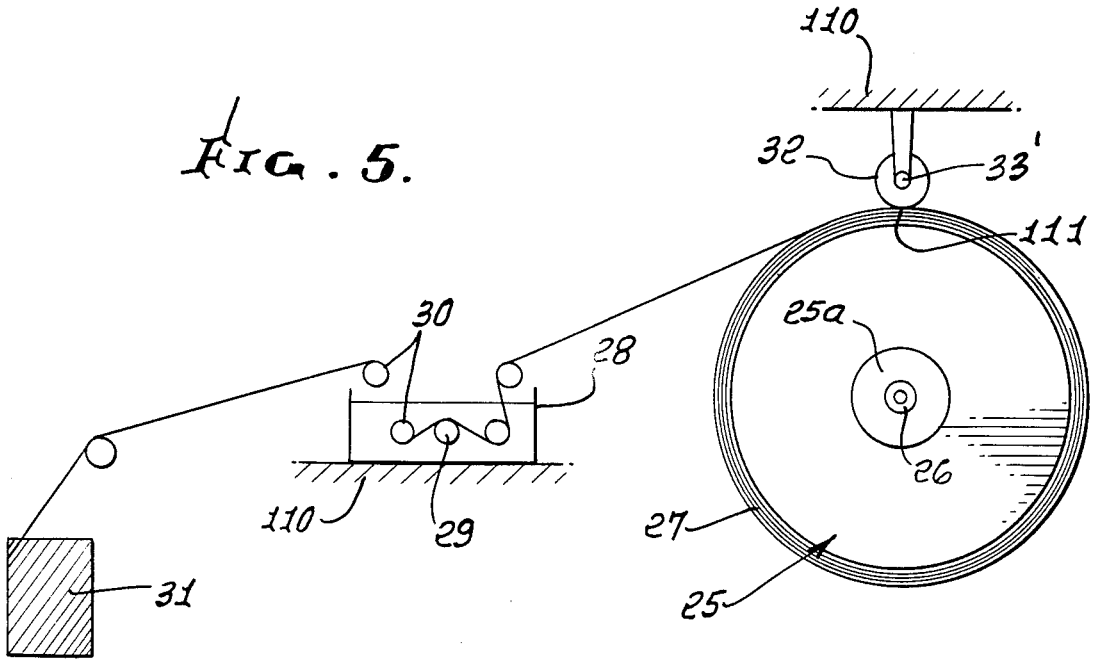
FIG. 5 is an elevation showing one application of the invention.

FIG. 5 is a diagrammatic representation of an application of the invention to a filament winding process, such as used in the manufacture or formation of a simple cylindrical pipe wall. A mandrel 25 is supported by, and rotated around a central bearing 26, as by drive 25*a*, so that resin impregnated roving 27 is wrapped in a predetermined fashion to form the pipe wall. Roving in a spool 31 is removed by conventional means, and is run over rollers 30 through a resin impregnation tank 28, which contains an ultrasonic roller 29 of the invention, to assist in de-airing, and in fiber impregnation.

A further ultrasonically actuated roller 32 is rotated around an axis 33 as the mandrel rotates, and is mechanically attached to the traverse mechanism of the tank 28 as it moves axially of the mandrel during the performance of the winding pattern. See support 110. The roller 32 is in spring or pneumatic actuated contact with the roving at a point 111 approximating the tangent of the roving to the pipe surface. Roller 32 has its axis parallel to that of the mandrel, and may have the form of one of the rollers of FIGS. 1–4. This illustrates examples of both the impregnation and densification applications of the invention.

Figure 6:
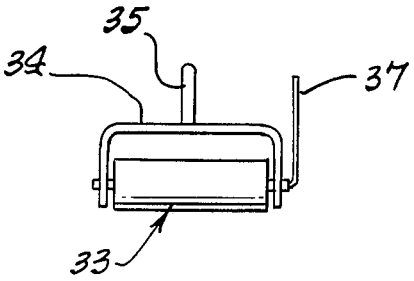
FIG. 6 is an elevation showing another application of the invention.

FIG. 6 illustrates a configuration of a hand held ultrasonic densification device of the invention. 33 is a vibratory surface, rotatable cylinder held in a yoke 34 to which a handle 35 is attached. The electrical conductor 37 is connected to a swivel connector means and to the internal transducers. The action is as previously described as a useful means of the densification of hand layup of composites either through a vacuum bag, or directly.

Figure 7:
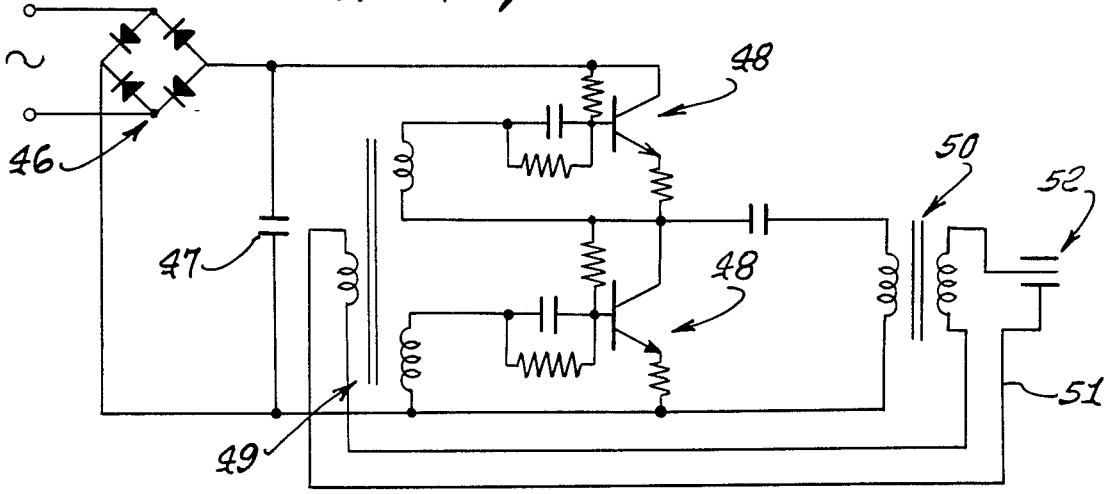
FIG. 7 is a circuit diagram.

FIG. 7 is a simplified schematic of a typical electrical device suitable for the generation of pulsating electrical energy of desired frequency and voltage to actuate the transducer means. Rectified voltage is derived from an alternating current source, via a rectifier 46 and a capacitor 47, and connected to the collector elements of a pair of power transistors 48 in a suitable multivibrator circuit. Two ferrite low loss transformers 49 and 50 complete the circuit to the transducer means 52 provided with a feedback path 51 to the input transformer. Details for successful operation of such circuits, such as impedance matching to the load and control of power levels and frequency are common engineering information to those in the field.

I claim:

1. The method of employing a body having a generally cylindrical wall to treat a work surface moving relative to the body, that includes (a) effecting vibration of said wall, to produce radial oscillation thereof, (b) causing said wall to rotate and to contact said relatively moving work surface while the wall rotates thereby to transmit said radial oscillation to said work surface, (c) said vibration being at a frequency or frequencies to cause densification of the work, (d) said (a) step carried out to produce wall oscillation along its length in contact with the work surface, (e) said body comprising a tube defining said wall, and said (a) step vibration being carried out to effect generally lengthwise oscillating displacement of the tube which results in corresponding generally radial oscillating displacement of the tube wall.

2. The method of employing a body having a generally cylindrical wall to treat a work surface moving relative to the body, that includes (a) effecting vibration of said wall, to produce expanding and contracting radial oscillation thereof, said vibration characterized by supersonic frequency, (b) causing said wall to rotate and to contact said relatively moving work surface while the wall rotates thereby to transmit said radial oscillation to said work surface, (c) said (a) step carried out to produce wall oscillation along its length in contact with the work surface, (d) said body comprising a tube defining said wall, and said (a) step vibration being carried out to effect generally lengthwise oscillating displacement of the tube which results in corresponding generally radial oscillating displacement of the tube wall.

3. The method of employing a body having a generally cylindrical wall to treat a work surface moving relative to the body, that includes (a) effecting vibration of said wall, to produce expanding and contracting radial oscillation thereof, (b) causing said wall to rotate and to contact said relatively moving work surface while the wall rotates thereby to transmit said radial oscillation to said work surface, (c) said (a) step carried out to produce wall oscillation along its length in contact with the work surface, (d) said wall having outwardly presented surface undulations lengthwise thereof, and said wall oscillation causing relative movement of said undulations for engagement with the work surface, (e) said body comprising a tube defining said wall, and said (a) step vibration being carried out to effect generally lengthwise oscillating displacement of the tube which results in corresponding generally radial oscillating displacement of the tube wall.

4. The method of employing a body having a generally cylindrical wall to treat a work surface moving relative to the body, that includes (a) effecting vibration of said wall, to produce radial oscillation thereof, (b) causing said wall to rotate and to contact said relatively moving work surface while the wall rotates thereby to transmit said radial oscillation to said work surface, (c) said (a) step carried out to produce wall oscillation along its length in contact with the work surface, (d) said body comprising a tube defining said wall, and said (a) step vibration being carried out to effect generally lengthwise oscillatory displacement of the tube which results in corresponding generally radial oscillatory displacement of the tube wall.

5. The method of claim 4 which includes pre-tensioning the tube during said lengthwise oscillatory displacement thereof.

6. The method of claim 5 including adjusting said tensioning of the tube to adjust the oscillatory displacement transmitted to the work surface.

7. The method of claim 4 wherein said oscillation is transmitted to the tube via opposite ends thereof.

8. The method of claim 7 including operating one transducer within the tube to effect oscillation transmission to the tube via opposite ends thereof.

9. The method of claim 7 including operating a plurality of transducers within the tube to effect oscillation transmission to the tube via opposite ends thereof.

10. The method of claim 9 wherein the transducer means comprise polarized piezoelectric ceramic material.

11. The method of claim 9 wherein the transducer means comprise a magneto-strictive material.

12. The method of claim 9 wherein the power for operating the transducer is transmitted through a connection coaxial with said end cap.

13. The method of claim 4 including operating transducer means within the tube to effect said oscillation of the tube.

14. The method of claim 13 including adjustably tensioning the tube during said lengthwise oscillatory displacement thereof.

15. The method of claim 13 wherein the work is traveled adjacent to a rotating mandrel, and including urging said tube toward the work to transmit force via the work to the mandrel during tube rotation.

16. The method of one of claims 13 and 15 wherein the work includes a synthetic resin.

17. The method of claim 13 wherein the frequency of said vibration is such as to cause densification of the work.

18. For use in treating a work surface, the combination comprising (a) a body having a generally cylindrical and rotating wall relative to which the work is movable, (b) means for causing said wall to contact the relatively moving work surface while the body wall rotates, (c) means associated with the body for effecting vibration of said wall to produce expanding and contracting radial oscillation thereof thereby to transmit said oscillation to said work surface, and (d) said radial and lengthwise oscillation being characterized by supersonic frequency, (e) said body comprising a tube defining said wall, said (c) means comprising transducer means associated with the tube to effect generally lengthwise oscillatory displacement of the tube which results in corresponding generally radial oscillatory displacement of the tube wall.

19. For use in treating work surface, the combination comprising (a) a body having a generally cylindrical and rotating wall relative to which the work is movable, (b) means for causing said wall to contact the relatively moving work surface while the body wall rotates, (c) means associated with the body for effecting vibration of said wall to produce expanding and contracting radial oscillation thereof thereby to transmit said oscillation to said work surface, and (d) said wall having outwardly presented surface undulations lengthwise thereof, and said wall oscillation causing relative movement of said undulations for engagement with the work surface, (e) said body comprising a tube defining said wall, said (c) means comprising transducer means associated with the tube to effect generally lengthwise oscillatory displacement of the tube which results in corresponding generally radial oscillatory displacement of the tube wall.

20. For use in treating a work surface, the combination comprising (a) a body having a generally cylindrical and rotary wall relative to which the work is movable, (b) means for causing said wall to contact the relatively moving work surface while the body wall rotates, (c) means associated with the body for effecting vibration of said wall to produce radial oscillation thereof thereby to transmit said oscillation to said work surface, (d) said (c) means being oriented to also produce wall oscillation along its length in contact with the work surface, and (e) said body comprising a tube defining said wall, said (c) means comprising transducer means associated with the tube to effect generally lengthwise oscillatory displacement of the tube which results in corresponding generally radial oscillatory displacement of the tube wall.

21. The combination of claim 20 including means for tensioning the tube during said lengthwise oscillatory displacement thereof.

22. The combination of claim 21 wherein said tensioning means includes at least one screw to adjust the oscillatory displacement transmitted to the work surface.

23. The combination of claim 20 wherein said transducer means is located within the tube.

24. The combination of claim 23 wherein said transducer means has an axis generally parallel to the tube so that the oscillation is transmitted to the tube via opposite ends thereof.

25. The combination of claim 24 wherein said transducer oscillatory amplitude is increased by acoustic transformer means.

26. The combination of claim 23 wherein said transducer means includes one elongated transducer extending axially between opposite ends of the tube and maintained in axial compression while the tube is tensioned.

27. The combination of claim 23 wherein said transducer means includes multiple transducers extending axially within the tube and maintained in axial compression while the tube is tensioned.

28. The combination of claim 23 wherein said transducer means includes two transducers respectively located adjacent end caps defined by the tube.

29. The combination of claim 23 wherein said (c) means includes an electrical connection with said transducer means and which passes through an end cap defined by the tube in such manner as to accommodate tube rotation.

30. The combination of claim 23 wherein the work is traveled adjacent a rotating mandrel, and said (b) means urges the tube toward the work to transmit force via the work to the mandrel during tube rotation.

31. The combination of claim 23 wherein said transducer means comprise piezoelectric material.

32. For use in treating a work surface, the combination comprising (a) a body having a generally cylindrical and rotary wall relative to which the work is movable, (b) means for causing said wall to contact the relatively moving work surface while the body wall rotates, (c) means associated with the body for effecting vibration of said wall to produce expanding and contracting radial oscillation thereof thereby to transmit said oscillation to said work surface, (d) and including the work which includes a synthetic resin, (e) said (c) means oriented to also produce wall oscillation along its length in contact with the work surface, (f) said body comprising a tube defining said wall, said (c) means comprising transducer means associated with the tube to effect generally lengthwise oscillatory displacement of the tube which results in corresponding generally radial oscillatory displacement of the tube wall.

33. For use in treating a work surface, the combination comprising (a) a body having a generally cylindrical and rotary wall relative to which the work is movable, (b) means for causing said wall to contact the relatively moving work surface while the body wall rotates, (c) means associated with the body for effecting vibration of said wall to produce expanding and contracting radial oscillation thereof thereby to transmit said oscillation to said work surface, (d) and including the work, and wherein said (c) means includes circuitry to produce body vibration at a frequency to cause densification of the work, (e) said (c) means oriented to also produce wall oscillation along its length in contact with the work surface, (f) said body comprising a tube defining said wall, said (c) means comprising transducer means associated with the tube to effect generally lengthwise oscillatory displacement of the tube which results in corresponding generally radial oscillatory displacement of the tube wall.

34. For use in treating a work surface, the combination comprising (a) a body having a generally cylindrical and rotary wall relative to which the work is movable, (b) means for causing said wall to contact the relatively moving work surface while the body wall rotates, (c) means associated with the body for effecting vibration of said wall to produce inward and outward radial oscillation thereof thereby to transmit said oscillation to said work surface, (d) and including a hand-held support supporting said body to rotate in contact with the work, (e) said (c) means oriented to also produce wall oscillation along its length in contact with the work surface, (f) said body comprising a tube defining said wall, said (c) means comprising transducer means associated with the tube to effect generally lengthwise oscillatory displacement of the tube which results in corresponding generally radial oscillatory displacement of the tube wall.

* * * * *